US007926757B2

(12) United States Patent
Fischer et al.

(10) Patent No.: US 7,926,757 B2
(45) Date of Patent: Apr. 19, 2011

(54) INSULATION SPOOL APPARATUS FOR LINING DUCTWORK

(75) Inventors: Bert Michael Fischer, Festus, MO (US); Dale R. Foster, Barnhart, MO (US)

(73) Assignee: Vicon Machinery, LLC, Pevely, MO (US)

( * ) Notice: Subject to any disclaimer, the term of this patent is extended or adjusted under 35 U.S.C. 154(b) by 95 days.

(21) Appl. No.: 12/358,213

(22) Filed: Jan. 22, 2009

(65) Prior Publication Data

US 2009/0184193 A1 Jul. 23, 2009

Related U.S. Application Data

(60) Provisional application No. 61/022,883, filed on Jan. 23, 2008.

(51) Int. Cl.
*B65H 67/00* (2006.01)

(52) U.S. Cl. ..... 242/559.2

(58) Field of Classification Search ..... 242/558, 242/559, 559.1, 559.2, 422.4, 422.5, 598, 242/598.3, 598.5, 599.3
See application file for complete search history.

(56) References Cited

U.S. PATENT DOCUMENTS 1,009,181 A * 11/1911 Ringrose ..... 242/422.5
1,250,217 A * 12/1917 Pfister ..... 242/559.2
1,449,093 A * 3/1923 Finley ..... 242/559.2
1,930,405 A * 10/1933 Vickery ..... 242/559.2
4,840,321 A * 6/1989 Focke et al. ..... 242/422.3
4,948,060 A * 8/1990 Kurz et al. ..... 242/559.2
6,095,454 A * 8/2000 Simmons et al. ..... 242/559
6,394,384 B1 * 5/2002 Alday et al. ..... 242/559.2

OTHER PUBLICATIONS

Engel Industries, Coiline—Full System, www.engelind.com/coiline, Jan. 8, 2008.
Iowa Precision, Pro-Ductomatic, www.iowaprecision.com/ducto, Jan. 8, 2008.
Vicon Machinery LLC, Photographs of prior art apparatus illustrated in Figure 1 taken at Vicon Machinery LLC plant.

* cited by examiner

*Primary Examiner* — William A Rivera
(74) *Attorney, Agent, or Firm* — Husch Blackwell LLP

(57) ABSTRACT

The present insulation spool apparatus is adapted for lining ductwork with insulation material and includes a pair of spaced apart first and second spool plates for holding and mounting a plurality of rolls of insulation material at one time, each individual roll of insulation material being rotatable into operative position for use. Each spool plate includes a plurality of receptacles for engaging and holding one end portion of an insulation roll support shaft. The spool apparatus may further include a plurality of hook plates for guiding the support shafts into locking engagement with the spool plates, locking mechanisms for holding the support shafts in a locked position with the spool plates, one or more paddle assemblies for providing sufficient tension force to each respective roll of insulation material for preventing premature unwinding during use, and a feeder mechanism for feeding and loading such rolled material onto the spool apparatus.

34 Claims, 8 Drawing Sheets

INSULATION SPOOL APPARATUS FOR LINING DUCTWORK

CROSS-REFERENCE

This application is a non-provisional application claiming priority to provisional Patent Application Ser. No. 61/022,883, filed Jan. 23, 2008, the entire disclosure of which is incorporated herein by reference.

BACKGROUND OF THE INVENTION

The present invention relates generally to roll forming equipment for making ductwork and, more particularly, to an apparatus for providing insulation material for attachment to sheet metal ductwork as the sheet metal moves along a production line prior to being completely formed into a duct-like shape for use in a wide variety of different residential, commercial and industrial applications such as heating, ventilation and air conditioning (HVAC) ductwork. In particular, the present invention relates to an apparatus for dispensing an insulation material for lining sheet metal ductwork.

Commercially produced rectangular or other shaped sheet metal ductwork is conventionally made in various lengths and widths depending upon the particular application. Such ductwork is roll formed in stages using appropriate roll forming equipment and is typically formed in sections. These duct sections are cut, notched and edged while moving along a production line. A typical section of sheet metal 210 for forming a section of ductwork is illustrated in FIG. 2. Prior to bending the sheet metal sections 210 into a preferably rectangular or other shaped ductwork, insulation material such as material 220 is generally adhered to what will become the inner surfaces of the finished ductwork. Lining the ductwork with insulation material improves the heating and/or cooling efficiency of the ductwork; it helps to prevent duct sweating; and it helps with noise abatement. Such insulation materials are typically packaged in rolls of various widths and/or lengths and are also available in various thicknesses and densities.

FIG. 1 discloses a prior art apparatus 100 for applying insulation material to a section of sheet metal for forming ductwork. The apparatus 100 includes a plurality of work stations including an adhesive depositing station 120, an insulation material application station 130, and a transition station 140. Attached to the apparatus 100 is a transverse reel or spool 110 for holding insulation material. Insulation material 112 is wound onto the transverse spool 110 for dispensing and distribution as will be further explained and is fed around guide roller 115 and through guider apparatus 116 to the transition station 140. Pinch roller mechanism 142 moves the insulation material 112 through the transition station 140 for mating with the sheet metal section at station 130. A conveyor system or assembly 150 conveys the various sheet metal sections through the various stations in a generally straight line along the longitudinal axis A.

The apparatus 100 includes a base 152 adapted for supporting the various components of the stations 120, 130, 140 and the conveyor system 150. The sheet metal sections are supplied from a typical coil duct processing system and are transported along a conventional conveyor belt system 150. The conveyor system 150 is provided with mechanisms to move the sheet metal sections and the insulation material preferably in synchronized linear motion along and onto the conveyor system 150.

As the sheet metal sections 210 are fed from a typical production line onto the conveyor system 150, these sections are first transferred to the adhesive depositing station 120. Station 120, as shown in FIG. 1, includes one or more adhesive depositors 122 positioned above the conveyor belt 154, each adhesive depositor 122 being operable to apply a predetermined quantity of adhesive material onto the upwardly facing surface of the sheet metal sections passing thereunder at selected locations therealong. The adhesive material is at a temperature adequate to provide the appropriate viscosity and cure time prior to the application of the insulation material 112 to the sheet metal section.

Once the adhesive material is applied, the conveyor system 150 conveys the sheet metal sections in a direction along axis A toward the insulation material application station 130. The transfer mechanism 140 is operable to feed and lower the insulation material sequentially downwardly and ultimately into engagement with the upwardly facing surface of a respective sheet metal section for contact with the adhesive material applied thereto. Cutters are associated with the transfer mechanism 140 for cutting the insulation material 112 into appropriate lengths for mating with the corresponding dimensional sheet metal sections. In this regard, appropriate computer control means are provided for controlling the cutting of the insulation material, the adhesive application, and the mating and joining of the sheet metal sections with the insulation material at the application station 130.

As illustrated in FIG. 1, the single transverse reel or spool 110 is removably mounted for rotation to the upper end portions of the support frames 114 in a conventional manner. The spool or reel 110 holds and supports a single roll of insulation material 112 which is to be fed downwardly along path B through guide mechanism 116 for feeding the insulation material into the transition station 140. The pinch roller mechanism 142 associated with the transition station 140 allows the insulation material 112 to be unwound off of the reel or spool 110 and moves the insulation material to the next work station and into engagement with the sheet metal section at station 130 as previously explained. The apparatus 100 includes a motor for rotating the pinch roller mechanism 142. Guide mechanisms 116 and 118 are disposed between the transverse spool 110 and the insulation material application station 130 for guiding the leading edge portion of the dispensed insulation material 112 through the transition station 140 to the application station 130.

The roll of insulation material 112 is compression rolled onto spool 110 as illustrated in FIG. 1 for use in the apparatus 100. The common procedure for installing the reel or spool 110 with insulation material 112 rolled thereon is to transport the spool 110 with insulation material thereon to the apparatus 100 and thereafter manually mount the rolled spool 110 onto the support frames 114. Installation is typically accomplished by two workmen physically lifting and properly positioning the rolled spool 110 onto appropriate apparatus associated with support frames 114. In this regard, each reel or spool 110 typically includes a shaft 111A which is removably positionable within the appropriate structure associated with the spool 110 such as a centrally located sleeve 111B. The sleeve 111B will house appropriate connection means for attaching the shaft 111A to the spool 110. Once mounted to the support frames 114, the spool 110 rotates between the support frames 114 and is supported by shaft 111A during operation of the apparatus 100.

The shaft 111A is typically removed from one spool 110 and inserted within another rolled spool 110 whenever a new roll of insulation material 112 is needed. For example, since the prior art apparatus 100 only holds a single spool or roll of insulation material 112, when a roll of insulation material is depleted, workmen must remove the empty spool 110 from the support frames 114 and thereafter remove the shaft 111A from such spool for insertion into a new fully loaded rolled spool of insulation material. Because of the weight associated with a fully loaded rolled spool of insulation material and the locking means associated with the prior art structures, two workmen are required to remove an existing spool 110 from the support frames 114, one workman on each opposite side of the spool. The same is likewise true when installing a new roll of insulation material 112 with its corresponding spool 110 onto the support frames 114. A single workman cannot accomplish this task. This is one of the deficiencies associated with the prior art devices of this type.

Still further, depending upon the particular job or application, differently sized sheet metal sections will be processed using the apparatus 100. Since a particular roll of insulation material 112 is sized to correspond with a particularly sized sheet metal section and for a particular application, when one job application is completed and a differently sized sheet metal section is processed immediately thereafter, the existing roll of insulation material 112 with its associated spool 110 must be removed and a new roll of insulation material 112 sized and shaped for the next application must be mounted on the apparatus 100 as previously explained. This requires stopping the entire production line, changing out the appropriate rolls of insulation material 112, and then restarting the production process. This is time consuming and again requires two workmen to accomplish the task.

This swapping of appropriately sized rolls of insulation material 112 also occurs whenever a different type of insulation material is to be used with a particular sheet metal section, or when a different insulation thickness is required for a particular job application. Again, since the prior art apparatus 100 holds and supports only a single roll of insulation material 112, constant change-out of the rolls of insulation material occurs causing production inefficiencies and delays in the overall process.

It is therefore desirable to provide an insulation spool apparatus which improves the overall insulation lining process including the time efficiency and workman efficiency for loading and unloading the insulation material including different types and different sizes of insulation material. It is also desirable to reduce the overall costs, labor and time associated with the loading and unloading process.

Accordingly, the present invention is directed to an insulation spool apparatus which overcomes one or more of the problems as set forth above.

SUMMARY OF THE INVENTION

The present invention overcomes many of the shortcomings and limitations of the prior art devices discussed above and teaches the construction and operation of several embodiments of an insulation spool apparatus adapted for lining ductwork wherein the spool mechanism includes a plurality of receptacles for holding and mounting a plurality of rolls of insulation material at one time, each individual roll of insulation material being rotatable into operative position for use in lining ductwork. The present apparatus greatly improves the overall efficiency of the entire lining process as compared to the prior art apparatus illustrated in FIG. 1 both with respect to installation efficiency and with respect to flexibility and efficiency in processing different job applications.

In one aspect of the present invention, the present insulation spool apparatus includes a pair of spaced apart first and second spool plates which are coupled to a drive shaft for rotational movement thereabout, each spool plate including a plurality of receptacles positioned and located along the perimeter thereof, the receptacles being adapted for engaging and holding one end portion of an insulation roll support shaft. When the first and second spool plates are coupled to the drive shaft and the present spool assembly is installed on the prior art apparatus 100 illustrated in FIG. 1, each receptacle associated with one spool plate is axially or horizontally aligned with a corresponding receptacle associated with the opposite spool plate. Each pair of axially aligned receptacles are configured for holding an insulation roll support shaft for rotational movement therewithin. As a result, a plurality of individual rolls of insulation material can be loaded onto the present spool assembly and, through the drive mechanism, the present spool assembly can be rotated so as to move any particular roll of insulation material into operative position for attaching the insulation material to sheet metal sections of ductwork. In this regard, an operator can select any one of the loaded rolls of insulation material for use for a particular job application by merely engaging the drive mechanism associated with the insulation spool assembly and rotating the proper roll of insulation material into operative position. In addition, great efficiency and time savings are achieved as compared to the prior art arrangement illustrated in FIG. 1 since new rolls of insulation material need not be reloaded until all of the mounted rolls of insulation material are completely consumed. In addition, since different types of insulation material including different sizes and different thicknesses of insulation material can be loaded onto the present spool assembly at one time, an operator can easily transition from one job application to another job application by merely rotating the proper roll of insulation material into the proper operative position as will be hereinafter further explained.

In another aspect of the present invention, the present insulation spool apparatus includes a plurality of hook plates which are peripherally spaced along the perimeter of each respective spool plate adjacent to the respective receptacles for holding the insulation roll support shafts. Each hook plate includes a shaft engaging recess formed at one end portion thereof, the recess being configured for engaging and guiding opposite end portions of an insulation roll support shaft into locking engagement with the spool plates as the present spool assembly is rotated in either a clockwise or counter-clockwise direction. In this regard, once a new roll of insulation material with its corresponding support shaft positioned within the spool member is positioned at a proper location on apparatus 100, an operator merely engages the spool assembly drive mechanism so as to rotate the aligned hook plates into engagement with a particular insulation roll support shaft. As the present spool assembly continues to rotate, the engaged insulation roll support shaft is guided along the surface of the respective hook plates into engagement with the aligned axial receptacles associated with the respective spool plates. As the present spool assembly continues to rotate, the particular insulation roll support shaft is maneuvered into proper position and is received within recesses associated with the aligned receptacles for holding the roll of insulation material in proper position on the spool assembly. Once a particular support shaft is engaged with a pair of aligned spool plate receptacles, locking means are engaged to hold the insulation roll support shaft in engagement with the respective spool plates.

In another aspect of the present invention, the first spool plate located on the operator's side of the apparatus 100 will include a manual shaft lock assembly associated with each adjacent axial receptacle for holding one end portion of an insulation roll support shaft in a locked position with the spool plate. This shaft lock assembly includes a pivotally rotatable lever member having one arm portion associated therewith movable between a first closed position wherein the arm portion extends across the insulation roll support shaft positioned within the spool plate receptacle, and a second open position wherein the arm portion is moved out of engagement with the insulation roll support shaft thereby allowing the support shaft to be removed from the spool plate receptacle. A manually insertable locking pin holds the lock assembly in its locked position thereby preventing the one end portion of the insulation roll support shaft from exiting the spool plate receptacle regardless of the orientation of such receptacle as the spool plate rotates throughout its entire 360° of travel. When the operator desires to remove or release the one end portion of the support shaft from that particular spool plate receptacle, the locking pin is removed and the lever member is rotated to its open position thereby allowing the operator to freely move the one end portion of the insulation roll support shaft out of engagement with that particular spool plate.

In another aspect of the present invention, the second spool plate located on the non-operator side of the apparatus 100 includes an automatic rotary latch assembly likewise located adjacent each spool plate receptacle, the rotary latch assembly being adaptable for holding the other end portion of an insulation roll support shaft in a locked position with the second spool plate. Unlike the manual lock assembly associated with the first spool plate on the operator side of the overall apparatus, the rotary latch assembly associated with the non-operator side spool plate automatically locks the opposite end portion of the insulation roll support shaft into the second spool plate receptacle as the present spool assembly is rotated during the loading process. This rotary latch assembly includes a rotary sprocket mechanism which rotates in one direction only and which resists and prevents rotation in the opposite direction. The sprocket mechanism includes a plurality of sprocket portions, one of which always extends across and closes the spool plate receptacle adapted for receiving the opposite end portion of the insulation roll support shaft. Each terminal end portion of each sprocket portion includes a beveled or angular portion adapted to engage the insulation roll support shaft as the support shaft is being guided by the hook plate into the spool plate receptacle. When the support shaft engages the particular sprocket portion extending across and closing the spool plate receptacle, the weight of the roll of insulation material in conjunction with the rotation of the present spool assembly as it rotates and lifts the roll of insulation material during the loading process supplies sufficient force against the sprocket portion so as to rotate the engaged sprocket portion in a direction to provide access to the spool plate receptacle thereby allowing the support shaft to be received therein. Since the rotary latch assembly rotates in one direction only, once the one end portion of the insulation roll support shaft is properly positioned within the spool plate receptacle, an adjacent sprocket portion is automatically moved into a closing position across the receptacle thereby preventing the insulation roll support shaft from exiting therefrom. This is likewise true for any particular angular orientation of the insulation roll support shaft as the spool assembly rotates throughout its full 360° of travel. Removal of the one end portion of the insulation roll support shaft from the automatic rotary latch assembly is accomplished by merely sliding that end portion of the support shaft laterally or horizontally until the support shaft is no longer engaged with the spool plate.

In still another aspect of the present invention, the present insulation spool apparatus may include one or more paddle assemblies which are properly positioned and spaced on separate support shafts associated with each respective roll of insulation material, the paddle assemblies providing sufficient tension force to each respective wound roll of insulation material thereby preventing such wound rolls of insulation material from prematurely unwinding during use. Spring members or other biasing means are used to bias the paddle assemblies against the rolls of insulation material so as to provide the necessary tensioning force.

In still another aspect of the present invention, the present insulation spool apparatus lends itself for use with a feeder mechanism for holding one or more rolls of insulation material and automatically feeding such rolls, one at a time, for loading onto the present spool apparatus.

The present insulation spool apparatus can be incorporated into any roll forming equipment or other apparatus designed for applying and attaching insulation material or other materials to sheet metal sections of ductwork or other work pieces in accordance with the teachings of the present invention.

It should be understood that the present drawings are not necessarily to scale and that the embodiments set forth herein are sometimes illustrated by graphic symbols, phantom lines, diagrammatic representations and fragmentary views. In certain instances, details which are not necessary for an understanding of the present invention or which render other details difficult to perceive may have been omitted. It should also be understood that the present invention is not necessarily limited to the particular embodiments illustrated herein. Like numbers utilized throughout the various Figures designate like or similar parts or structure.

DETAILED DESCRIPTION OF THE INVENTION

Figure 3:
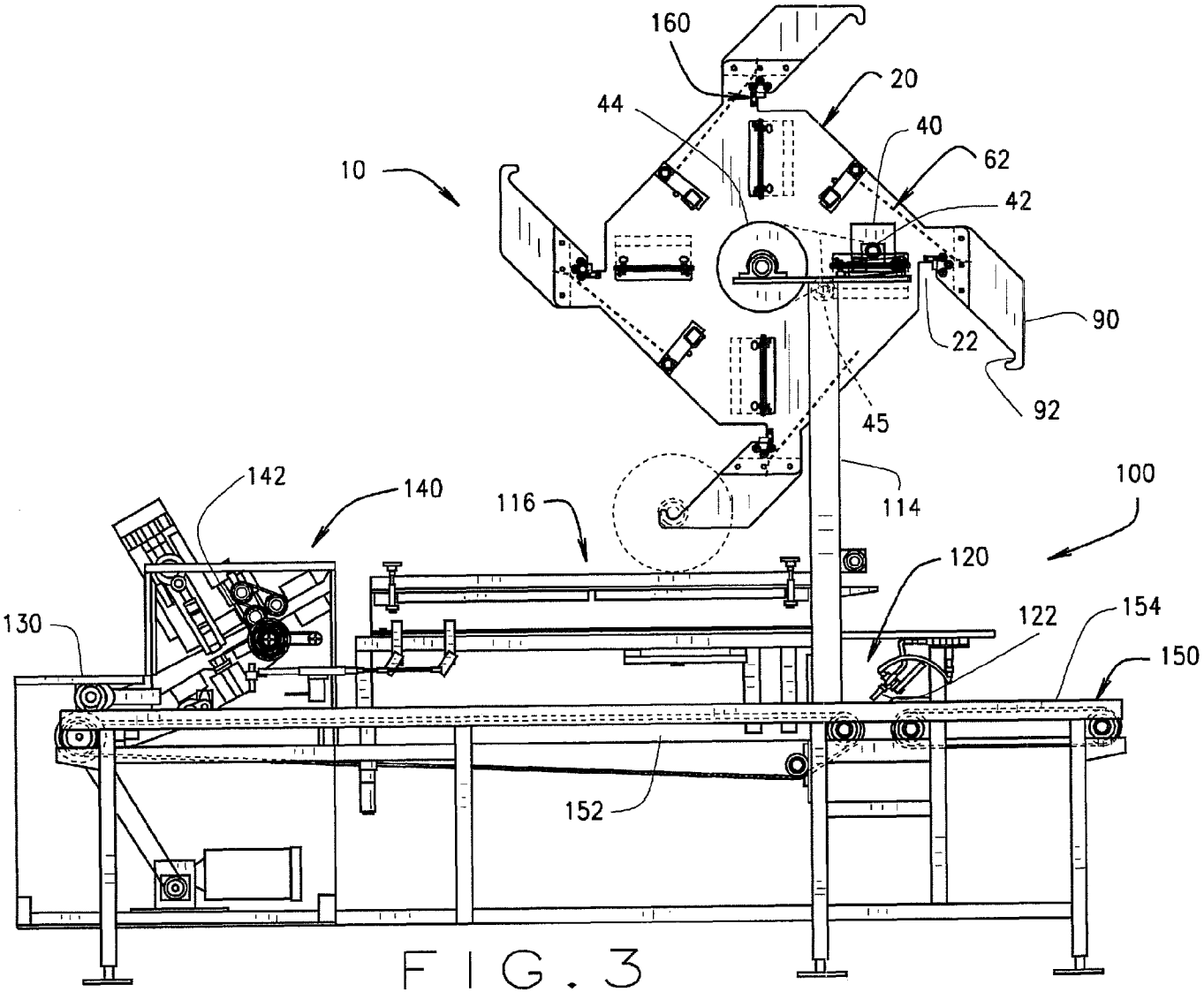
FIG. 3 is a side elevational view of a spool apparatus for applying insulation material to sheet metal ductwork constructed according to the teachings of the present invention.
Figure 4:
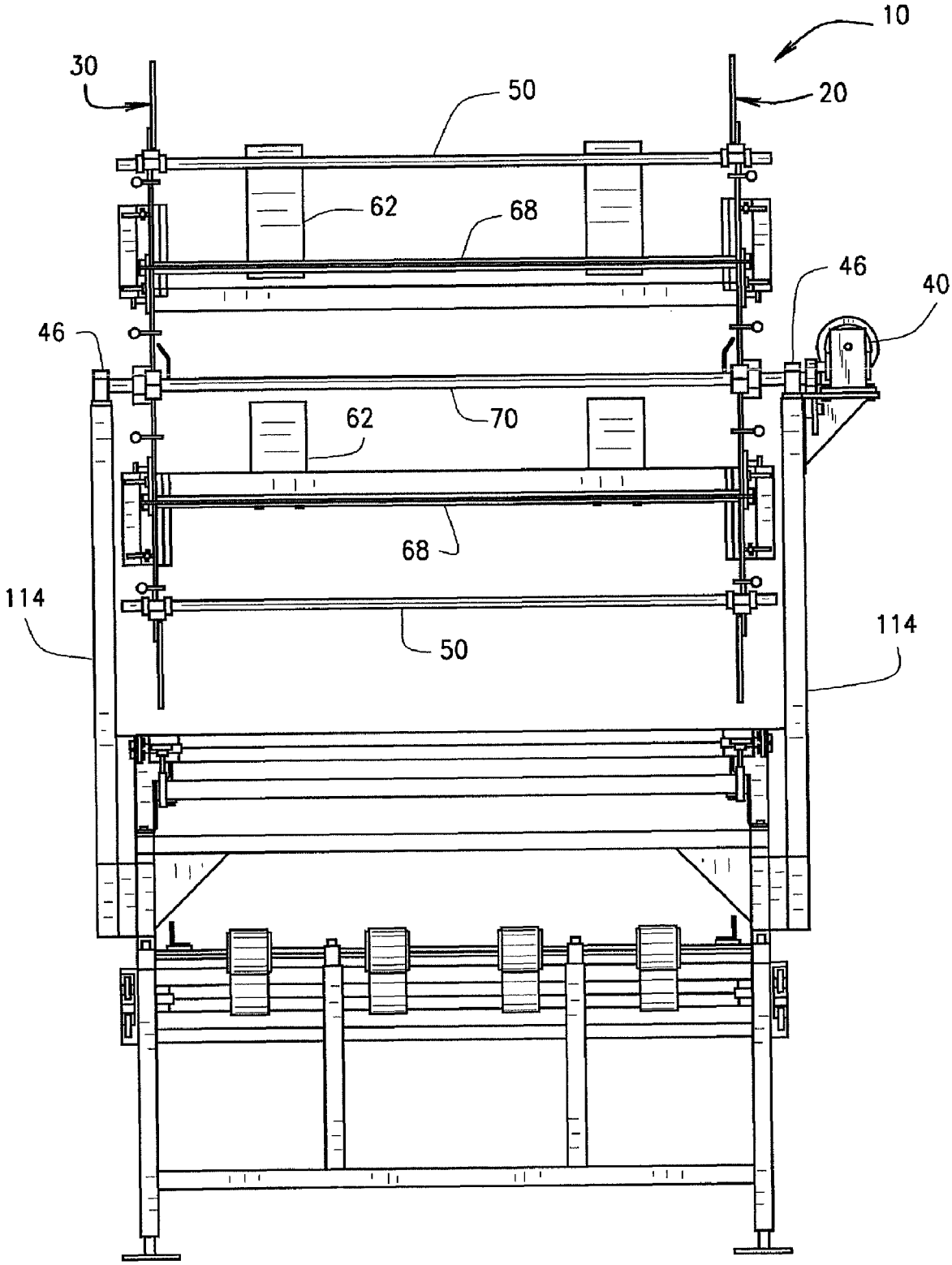
FIG. 4 is a front elevational view of the apparatus of FIG. 3.

Referring to the drawings more particularly by reference numbers, the numeral 10 in FIGS. 3 and 4 identify one embodiment of an insulation spool apparatus for mating and lining insulation material to sections of sheet metal ductwork constructed in accordance with the teachings of the present invention. The insulation spool apparatus 10 can be manufactured so as to be compatible for attachment to any suitable type of apparatus for feeding and attaching insulation material to sheet metal ductwork or other appropriate products. The insulation spool apparatus 10 includes a first spool plate 20, a second spool plate 30, a spool motor 40 for driving the spool apparatus 10, an appropriate drive mechanism including sprockets 42 and 44, a drive shaft 70, one or more insulation roll support shafts 50, and one or more paddle assemblies 60 as illustrated in FIGS. 3-5, 7 and 10. Each of the first and second spool plates 20 and 30 includes one or more axial receptacles 22 and 32 for receiving the respective insulation roll support shafts 50 as well as one or more hook plates 90 for facilitating loading and installation of the respective rolls of insulation material onto the spool assembly 10. Although the specific apparatus disclosed and discussed herein is directed to a mechanism for applying and attaching insulation material to sections of sheet metal ductwork, it is recognized and anticipated that the present installation spool assembly 10 can be utilized with any machine or apparatus where insulation or other suitable materials are to be dispensed for lining and/or attaching such materials to a particular product or work piece. The present spool apparatus 10 is shown in FIG. 3 as being attached to a conventional apparatus for applying and attaching insulation material to sections of sheet metal ductwork such as the prior art apparatus 100 illustrated in FIG. 1, the prior art spool 110 having been replaced with the present insulation spool apparatus 10.

Figure 5:
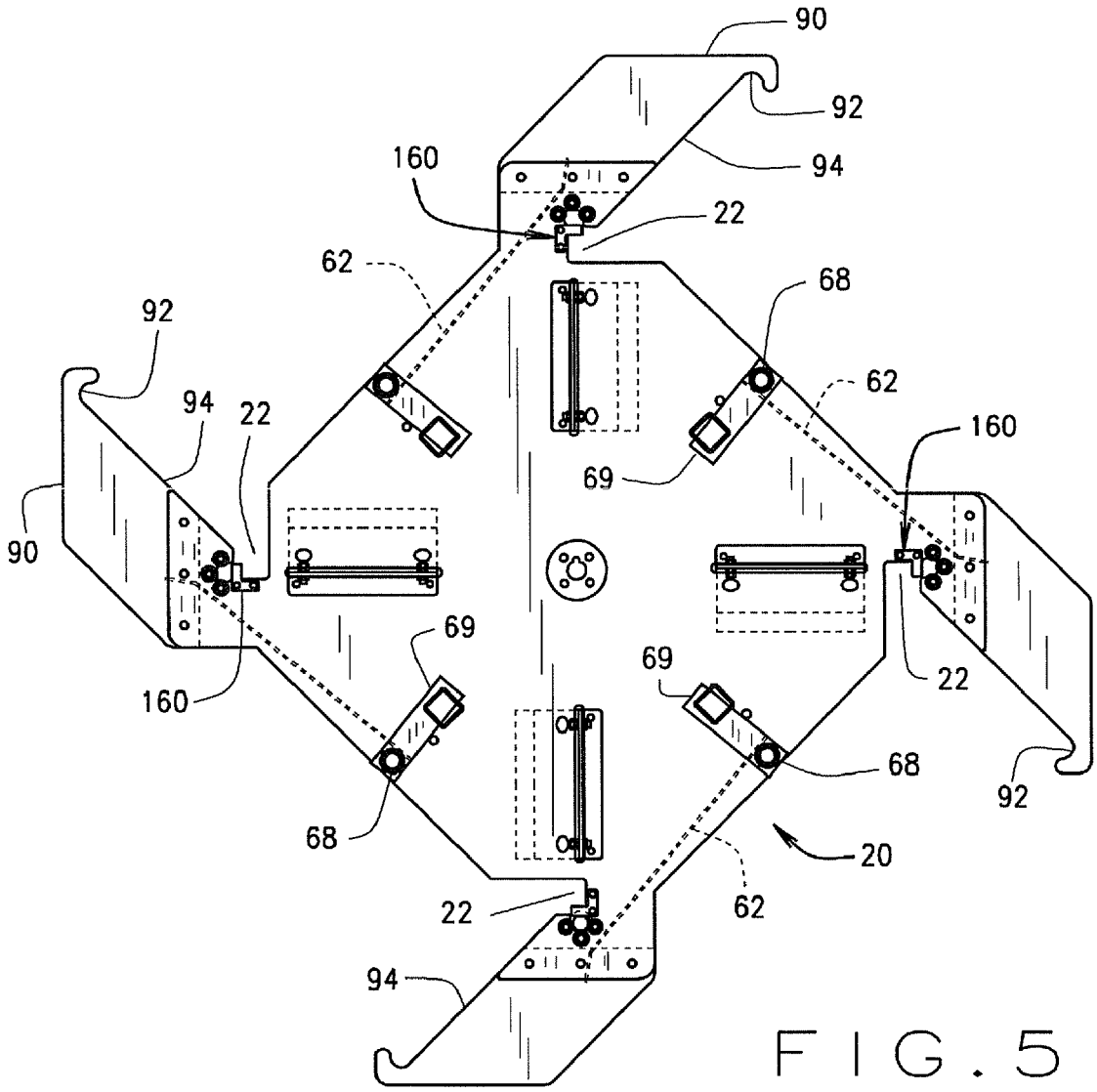
FIG. 5 is a side elevational view of one of the spool plates associated with the apparatus of FIG. 3.
Figure 7:
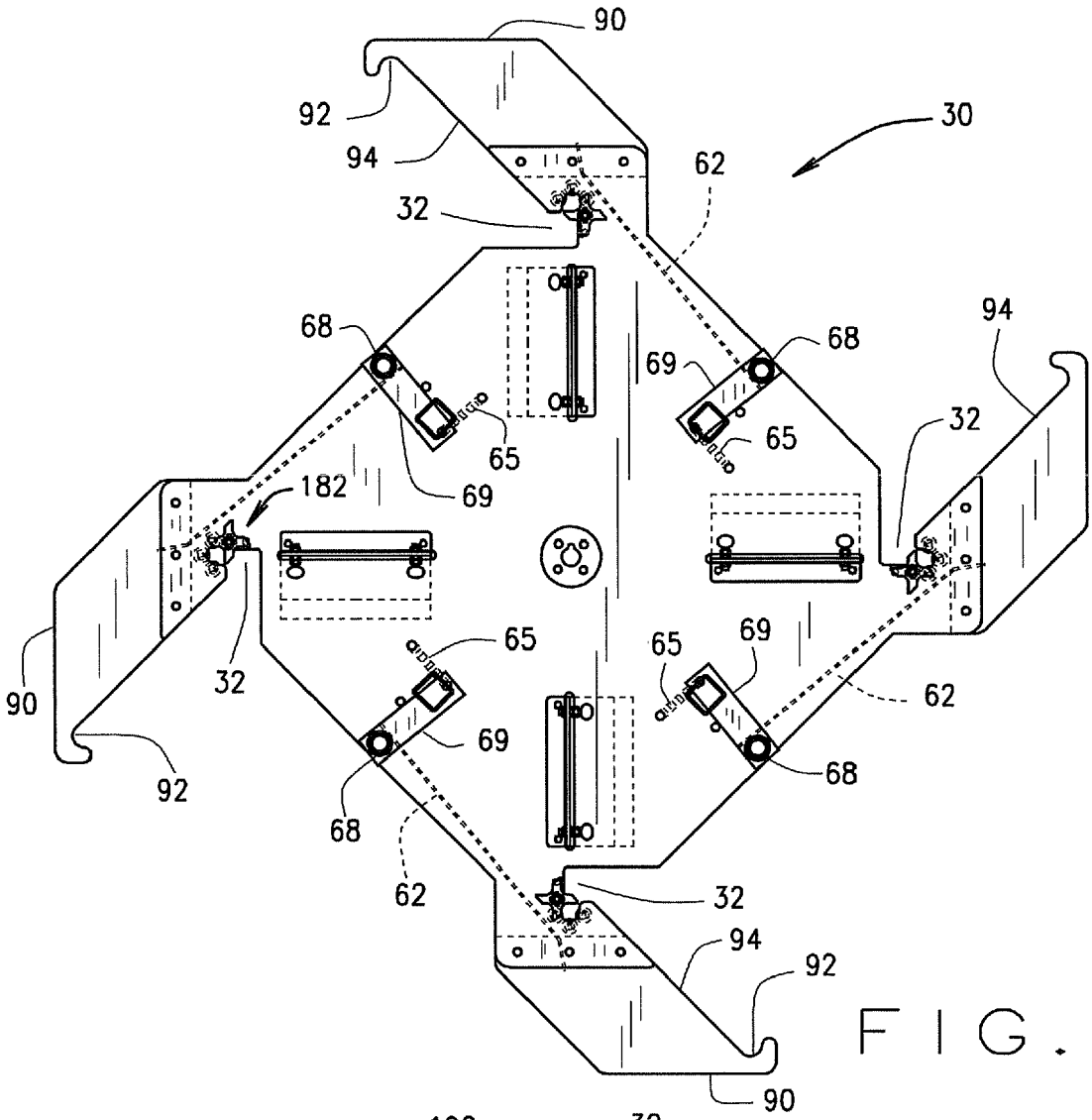
FIG. 7 is a side elevational view of the other spool plate associated with the apparatus of FIG. 3.

As best shown in FIGS. 5 and 7, the present insulation spool apparatus 10 includes a pair of spool plates 20 (FIG. 5) and 30 (FIG. 7) which are laterally spaced apart from each other as best illustrated in FIG. 4. As will be hereinafter further explained, the first spool plate 20 is generally positioned and located on the operator's side of the overall apparatus 100, that is, the side which typically includes the operator control panel and other operator switches and mechanisms for controlling the operation of the overall machinery, and the second spool plate 30 is typically located on the opposite side thereof, that is, on the non-operator side of the apparatus 100. The spool plates 20 and 30 are operatively engaged to each other through the drive shaft 70 in a conventional manner as illustrated in FIG. 4. This would include appropriate hub and bearing mechanisms for mounting and attaching the respective spool plates 20 and 30 to the drive shaft 70. Although the shape of the spool plates 20 and 30 illustrated in FIGS. 5 and 7 are generally rectangular in shape, it is recognized and anticipated that the spool plates 20 and 30 can take on any shape and dimension depending upon the machinery to which it will be attached.

Figure 6:
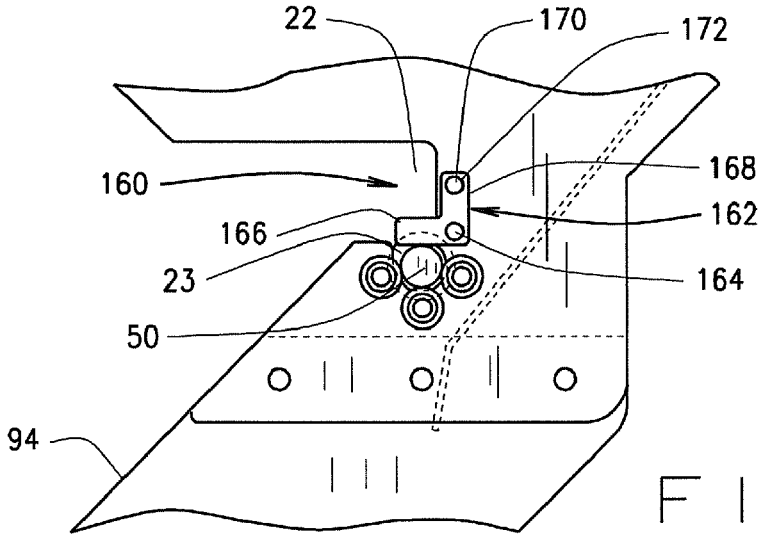
FIG. 6 is an enlarged fragmentary front elevational view of the shaft lock assembly constructed according to the teachings of the present invention.
Figure 8:
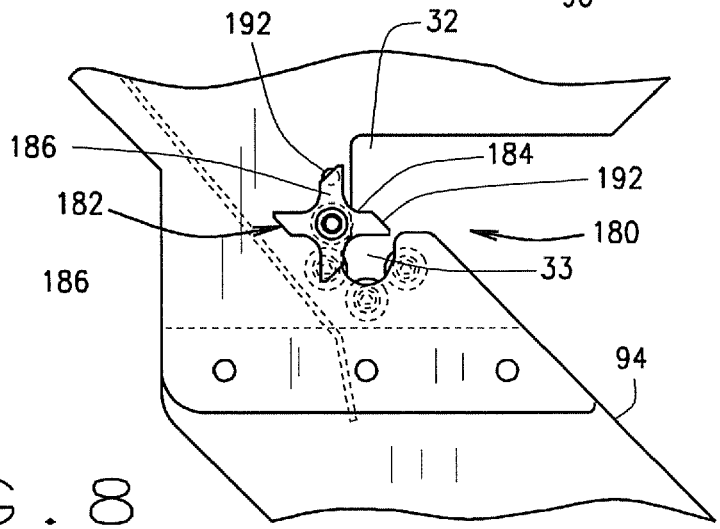
FIG. 8 is an enlarged fragmentary front elevational view of the rotary latch assembly constructed according to the teachings of the present invention.

In one embodiment, the respective spool plates 20 and 30 each include a plurality of receptacles 22 and 32 adapted for receiving and mounting the support shafts 50 associated with each insulation roll to be attached to the overall spool apparatus 10. In this regard, as best illustrated in FIGS. 4, 5 and 7, when the spool plates 20 and 30 are engaged with the drive shaft 70, respective pairs of the receptacles 22 and 32 are positioned and located in axial alignment with each other for receiving one end portion of a particular insulation roll support shaft 50 as illustrated in FIG. 4. The axial receptacles 22 and 32 include substantially semi-cylindrical recesses 23 and 33 as best illustrated in FIGS. 6 and 8 which are adapted for receiving the respective support shafts 50 as will be hereinafter further explained. The support shafts 50 are substantially similar to the spool shaft 111A illustrated in FIG. 1 and are removably insertable within appropriate attachment means associated with each respective spool for carrying the insulation material as previously explained with respect to the prior art spool 110 and its associated centrally located sleeve 111B. Each of the respective first and second spool plates 20 and 30 are configured to include a plurality of axial receptacles 22 and 32 positioned and located in spaced apart relationship along the perimeter or circumference of the first and second spool plates as illustrated in FIGS. 5 and 7. The spacing between the axial receptacles 22 and 32 is dependent upon the size of the spools 110 to be installed thereon, the spacing being such that each individual spool 110 with its associated insulation material wound thereon will be capable of rotating and unwinding the insulation material positioned thereon without interference with other insulation spools positioned on the spool apparatus 10. Since each axial receptacle 22 of the first spool plate 20 is axially and horizontally aligned with a corresponding axial receptacle 32 associated with the second spool plate 30, each pair of axial receptacles 22 and 32 are configured to receive and hold a respective insulation roll support shaft 50 for rotational movement within each pair of receptacles as will be hereinafter further explained.

Since the respective spool plates 20 and 30 include a plurality of spaced apart, aligned axial receptacles 22 and 32, a plurality of rolled insulation spools 110 can be loaded onto the insulation spool apparatus 10 at any point in time, one insulation spool being associated with each pair of axial receptacles 22 and 32. In the embodiment illustrated in FIGS. 3-5 and 7, the spool apparatus 10 can accommodate four separate rolls of insulation material 112. Also, importantly, each pair of aligned axial receptacles 22 and 32 can accommodate and hold insulation material of different types, sizes and/or thicknesses depending upon the different job application to be fed through the apparatus 100 on any particular day. As will be explained, the operator of the apparatus 10 and 100 can select any one of the rolls of insulation material 110 loaded onto the present spool apparatus 10 by rotating the insulation spool assembly 10 to the proper position for dispensing the insulation material associated with any one of the spools 110 loaded thereon as will be hereinafter further explained.

As best illustrated in FIGS. 3 and 4, the insulation spool apparatus 10 is driven by the spool motor 40. The drive shaft 70 is coupled to the spool motor 40 in a conventional manner and is adapted to rotate in both directions through operation of the spool motor 40. The drive shaft 70 is rotatably mounted to the support frames 114 as illustrated in FIG. 4 through the use of respective pillow block bearings 46 or other appropriate means. The fixed vertical support frames 114 support the drive shaft 70 and the insulation spool assembly 10 coupled thereto in a conventional manner. A drive sprocket 42 associated with the spool motor 40 is coupled to the spool sprocket 44 through the use of a drive chain 45 as best shown in FIG. 3. The spool sprocket 44 is coupled to the drive shaft 70 such that when the spool motor 40 is activated, the drive shaft 70 can be rotated in either a clockwise or counter-clockwise direction. This allows an operator to physically rotate and position a particular roll of insulation material loaded onto the spool assembly 10 for feeding through the guide mechanism 116 and ultimately mating with a sheet metal section at application station 130 as previously explained with respect to FIG. 1. Although a specific drive system has been discussed herein, it is recognized and anticipated that other drive mechanisms for rotating the insulation spool assembly 10 in both a clockwise and counterclockwise direction can be utilized and will be apparent to those skilled in the art.

As best shown in FIGS. 5 and 7, the first and second spool plates 20 and 30 likewise include one or more hook plates 90 which are peripherally spaced along the perimeter or circumference of each respective spool plate. The hook plates 90 are associated with the respective pairs of axial receptacles 22 and 32 and can be either integrally formed with the respective spool plates 20 and 30, or the hook plates 90 can be individually attached to the spool plates 20 and 30 as illustrated in FIGS. 5 and 7. Each hook plate 90 is positioned and located adjacent the axial receptacles 22 and 32 and each includes a shaft engaging recess 92 associated with one end portion thereof as best illustrated in FIGS. 5 and 7. Each shaft engaging recess 92 is positioned, located and formed so as to engage one end portion of an insulation roll support shaft 50 when an insulation roll is positioned upon the guide mechanism 116 and the spool apparatus 10 is rotated in a clockwise direction as best visualized in FIG. 3. Once a fully loaded roll of insulation material with its appropriate support shaft 50 extending therethrough is positioned on the guide mechanism 116, an operator can simply engage the spool motor 40 and rotate the insulation spool assembly 10 such that a respective pair of hook plates 90 associated with a corresponding pair of aligned axial receptacles 22 and 32 will freely engage respective opposite end portions of the insulation roll support shaft 50 and its associated spool 110 positioned on the guide mechanism 116. The rotational movement of the spool plates 20 and 30 will engage the insulation roll support shaft 50 as illustrated in FIG. 3. Once the insulation roll support shaft 50 is engaged by a respective pair of hook plate recesses 92, further rotation of the first and second spool plates 20 and 30 in a clockwise direction as viewed in FIG. 3 will allow the engaged insulation roll support shaft 50 to be lifted and the angled hook plate surface 94 will guide the support shaft 50 therealong into engagement with the receptacles 22 and 32. Further rotation of the first and second spool plates 20 and 30 will allow the opposite end portions of the insulation roll support shaft 50 to engage the recesses 23 and 33 as best illustrated in FIGS. 6 and 8. Once the support shaft 50 is engaged with the recesses 23 and 33, appropriate locking means as will be hereinafter explained will hold the support shaft 50 in its proper position on the respective spool plates 20 and 30. The hook plates 90 therefore facilitate the loading of each individual roll of insulation material onto the insulation spool assembly 10 and this can be accomplished by a single workman who will activate the spool motor 40 and rotate the insulation spool assembly 10 in the appropriate direction to engage and lock a respective insulation roll support shaft 50 in the recesses 23 and 33 as will be hereinafter further explained. This greatly reduces both the labor and time associated with loading a new roll of insulation material onto the spool assembly 10 and it allows one workman to accomplish this task.

Each spool plate 20 and 30 includes a locking mechanism for holding and retaining each respective insulation roll support shaft 50 within each respective pairs of receptacles 22, 23, 32 and 33 as each respective roll of insulation material travels around the spool assembly 10. More particularly, a manually operated shaft lock assembly 160 is located adjacent each receptacle 22 associated with the first spool plate 20 and an automatic rotary latch assembly 180 is located adjacent each receptacle 32 associated with the second spool plate 30. As best illustrated in FIGS. 5 and 6, the shaft lock assembly 160 includes a substantially L-shaped arm member 162 rotatably mounted via a pivot pin 164 at the intersection of arm portions 166 and 168. The arm member 162 rotates about pivot pin 164 between a first locked position wherein arm portion 166 extends across both the recess 23 and the support shaft 50 positioned therewithin, and a second open position (not shown) wherein arm portion 166 is rotated clockwise about pivot pin 164 to a position where arm portion 166 no longer extends across recess 23 or the support shaft 50 positioned therein. The shaft lock assembly 160 likewise includes a locking pin 170 associated with arm portion 168 which is adapted for being inserted through opening 172 associated with arm portion 168 and through a corresponding opening (not shown) associated with the first spool plate 20 for holding and locking the arm member 162 in its lock position as illustrated in FIG. 6. Locking pin 170 can be manually operated by the operator of the apparatus 10 and 100 and, when the arm member 162 is in its locked position. When pin member 170 is engaged with the arm member 162 and spool plate 20, the arm portion 166 extending over the support shaft 50 will prevent support shaft 50 from exiting the recess 23 regardless of the orientation of such recess as the spool assembly 10 is rotated throughout its full 360° of travel.

As best illustrated in FIG. 5, each respective shaft lock assembly 160 has its corresponding arm portion 166 blocking the semi-cylindrical recess 23 and the corresponding insulation roll support shaft 50 positioned therein thereby preventing the support shaft 50 from becoming disengaged from the spool plate 20 at any orientation as the respective rolls of insulation material travel in a circular direction around the spool plate 20. Although the arm member 162 is illustrated as being substantially L-shaped in structure, it is recognized and anticipated that the arm member 162 can take on any shape so long as a portion thereof extends across recess 23 and prevents the support shaft 50 from becoming disengaged from the spool plate 20. Locking pin 170 holds the lock assembly 160 in its locked position and prevents arm portion 166 from moving out of such position until pin member 170 is manually released by the operator.

Loading and unloading of a particular roll of insulation material into and out of the receptacles 22 associated with spool plate 20 can be accomplished in the following manner. An operator will first remove the locking pin 170 from engagement with both the arm member 162 and the spool plate 20 and will thereafter rotate the arm member 162 to its open position wherein arm portion 166 no longer blocks recess 23 and/or support shaft 50. If an insulation roll support shaft is located within the receptacle 22/23, an operator can remove the support shaft from engagement therewith. If a new roll of insulation material is to be loaded onto spool plate 20, removal of the locking pin 170 from the lock assembly 160 will allow the arm member 162 to rotate to its open position as the spool plate 20 is rotated in a clockwise direction to both engage and guide the support shaft 50 associated with a new roll of insulation material into engagement with the recess 23. As the spool plate 20 continues to rotate upwardly in a clockwise direction, the lock assembly 160 will remain in its open position as the support shaft 50 moves into recess 23 as previously explained. Once support shaft 50 is properly located within recess 23, the arm member 162 can be rotated to its closed position and lock pin 170 can be reinserted to hold the lock assembly 160 in its closed position. Again, one workman, namely, the operator of the overall apparatus 10 and 100, can accomplish the locking and unlocking of shaft lock assembly 160 and the loading of a new support shaft 50 within each respective receptacle 22 associated with spool plate 20.

Figure 9:
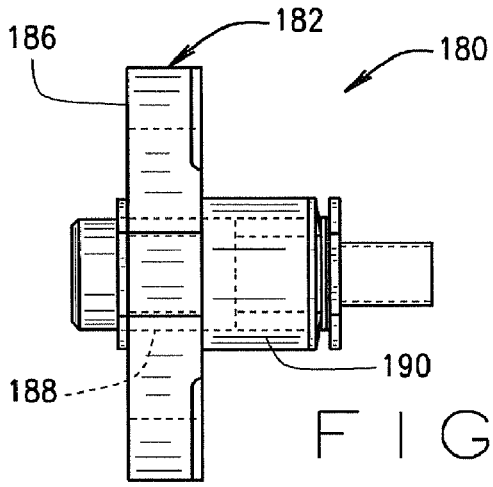
FIG. 9 is an enlarged fragmentary side elevational view of the rotary latch assembly of FIG. 8.

As best illustrated in FIGS. 7, 8 and 9, the second spool plate 30 includes one or more automatic rotary latch assemblies 180 located adjacent each axial receptacle 32 and its corresponding semi-cylindrical recess 33. The rotary latch assembly 180 includes a rotary sprocket member 182 having a plurality of spaced slots 184 located between respective sprocket portions 186. The rotary latch assembly 180 includes a roller clutch bearing 188, a needle roller bearing 190, and other appropriate mechanisms for allowing the sprocket member 182 to move or rotate in one direction only, namely, in a clockwise direction as illustrated in FIG. 8. The roller clutch bearing 188 and the needle roller bearing 190 prevent the sprocket member 182 from rotating in a counter-clockwise direction. This is important as will be hereinafter explained.

As illustrated in FIGS. 7 and 8, the rotary latch assembly 180 is mounted to spool plate 30 adjacent each receptacle 32 and its corresponding semi-cylindrical recess 33 such that one of the sprocket portions 186 extends across and blocks the recess 33. As with receptacle 22 and recess 23, recess 33 is likewise adapted to receive and hold one end portion of an insulation roll support shaft 50 which will be guided along the angled hook plate surface 94 for reception into receptacle 32 and ultimately into recess 33. In this regard, each terminal end portion of each sprocket portion 186 includes a beveled or tapered surface 192 (FIG. 8) such that as the one end portion of the insulation roll support shaft 50 travels along the hook plate surface 94, the support shaft 50 will first engage the beveled or tapered sprocket portion 192 and the weight of the roll of insulation material will allow the support shaft 50 to move the engaged sprocket portion 186 in a clockwise direction as illustrated in FIG. 8 as the support shaft 50 continues to move into the receptacle 32 and the corresponding slot 184 located between the engaged sprocket portion and its adjacent sprocket portion 186. As the spool plate 30 continues to rotate upwardly after hook plate 90 engages the support shaft 50, the weight of the support shaft 50 and the insulation material wound on the spool 110 will rotate the engaged sprocket portion 186 clockwise thereby allowing the support shaft 50 to enter the recess 33. Once the support shaft 50 enters recess 33, it will push the engaged sprocket portion 186 to a position sufficient to allow an adjacent sprocket portion 186 to move into a locking position whereby the adjacent sprocket portion 186 again extends over and closes the recess 33 thereby preventing support shaft 50 from exiting such recess and the spool plate 30.

Since the sprocket member 182 can only rotate in a clockwise direction, any weight or force of the support shaft 50 or its associated roll of insulation material applied against the sprocket portion 186 closing the recess 33 will be resisted by the clutch and needle bearings 188 and 190 and other mechanisms associated with the rotary latch assembly 180. This arrangement automatically locks the support shaft 50 to the spool plate 30 and prevents the support shaft 50 from exiting the recess 33. As discussed with respect to the shaft lock assembly 160 associated with the first spool plate 20, the rotary latch assembly 180 associated with the second spool plate 30 will likewise hold and prevent a respective support shaft 50 from exiting recess 33 at any angular position as the spool plate 30 is rotated throughout its entire 360° of travel. This is illustrated in FIG. 7. Removal of a particular support shaft 50 from the recess 33 associated with each respective receptacle 32 can be easily accomplished by merely sliding the support shaft 50 in a lateral or horizontal direction until the terminal end portion of the support shaft is free of the sprocket member 182. This typically occurs after the opposite end portion of the support shaft 50 has been removed from its corresponding receptacle 22 associated with the first spool plate 20 as previously explained.

Since the rotary latch assembly 180 automatically locks a particular shaft 50 into its proper position within the second spool plate 30 as previously explained, it is not necessary to have a workman positioned on the non-operator side of the apparatus in order to load and unload a particular roll of insulation material. Once a particular roll of insulation material is positioned on the guide mechanism 116 as previously explained, a single operator of the apparatus 10 and 100 can maneuver and manipulate the respective insulation roll support shaft 50 to both load and unload a particular insulation roll support shaft 50 from the insulation spool assembly 10. Here again, for example, if an operator is removing an expended spool of insulation material from insulation spool assembly 10, the operator will first position the insulation spool assembly 10 such that the appropriate pair of aligned receptacles 22 and 32 holding a particular support shaft 50 is positioned over guide assembly 116 as illustrated in FIG. 3. The operator will then unlock the shaft lock assembly 160 associated with spool plate 20 which is located on the operator's side of the overall mechanism 100, and the operator will thereafter remove the support shaft 50 from spool plate 20 and thereafter slide the opposite end portion of that particular support shaft 50 in a lateral or horizontal direction until its opposite end portion is free from the rotary latch assembly 180 associated with spool plate 30. The empty spool with its corresponding support shaft 50 is now disengaged from the insulation spool assembly 10 and can be easily maneuvered and picked up by a single workman for removal from the apparatus 100.

In similar fashion, the loading of a new roll of insulation material is accomplished in a manner as previously described wherein, once the new roll of insulation material with its appropriate support shaft 50 attached thereto is placed in proper position on guide mechanism 116 as illustrated in FIG. 3, the operator will unlock the shaft lock assembly 160 and will rotate the insulation spool assembly 10 such that the appropriate pair of hook plates 90 associated with the first and second spool plates 20 and 30 will engage the respective opposite end portions of the support shaft 50 associated with the new roll of insulation material and the support shaft 50 will be engaged with the respective receptacles 22 and 32 and their corresponding recesses 23 and 33 as previously explained. Since the rotary latch assembly 180 automatically locks the support shaft 50 into the spool plate 30, a single operator can load and unload rolls of insulation material.

Figure 10:
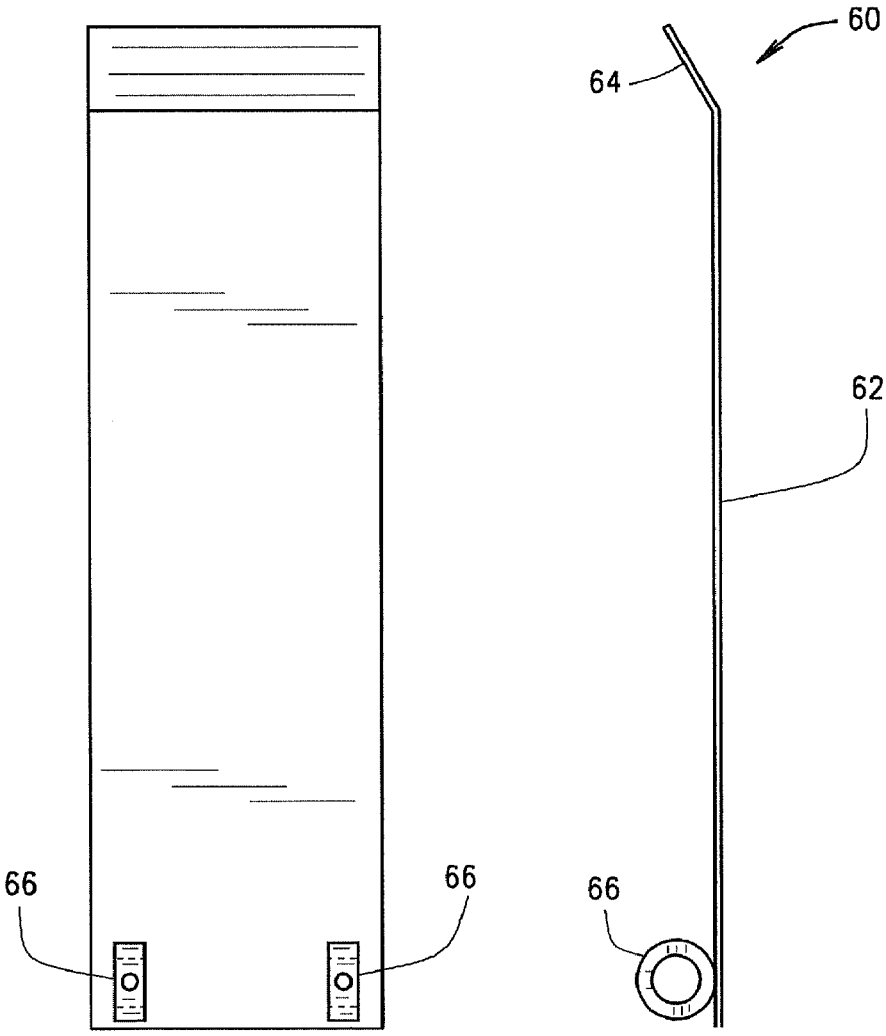
FIG. 10 illustrates front and side elevational views of a paddle assembly constructed according to the teachings of the present invention.

As best illustrated in FIGS. 3, 4, 5 and 10, the insulation spool apparatus may likewise include one or more paddle assemblies 60. The paddle assemblies 60 are positioned and located so as to engage a respective roll of insulation material and apply a tensioning force thereagainst so as to prevent the roll of insulation material from unwinding. The paddle assembly 60 includes at least one paddle member 62 as best illustrated in FIG. 10 having one end portion thereof secured to a support shaft 68 via attachment means 66. A support shaft 68 is associated with each roll of insulation material attachable to the insulation spool assembly 10 and each support shaft 68 is positioned and located such that the paddle member 62 will engage a corresponding roll of insulation material. Each support shaft 68 is coupled at its opposite end portions to the respective spool plates 20 and 30 as illustrated in FIGS. 5 and 7 so as to be rotatable thereabout. Each support shaft 68 is likewise attached to a lever member 69 associated with each opposite end portion thereof, at least one of the lever members 69 being attached to a spring member such as the spring member 65 associated with spool plate 30 illustrated in FIG. 7. The spring member 65 has one end portion fixedly attached to the lever member 69 and has its opposite end portion fixedly attached to the spool plate 30. The lever members 69 are free to rotate adjacent spool plates 20 and 30 based upon the biasing force of spring member 65 as will be hereinafter explained. It is likewise recognized and anticipated that spring members 65 could also be associated with spool plate 20 and the lever members 69 associated therewith. Attachment means 66 can be a cylindrical adjustable clamp mechanism or any other suitable mechanism for attaching one end portion of the paddle member 62 to its respective support shaft 68. Once the paddle member 62 is attached to a respective support shaft 68, the biasing action of spring member 65 is such that the paddle member 62 will engage and apply a tensioning force against the wound roll of insulation material. This applied tensioning force helps to prevent premature unwinding of the roll which may occur if a particular roll of insulation material is not being utilized for a particular application, or if the utilized roll of insulation material is not being unwound at any particular time during the application process. Due to the length, thickness and weight of such insulation materials, it is not uncommon for such wound rolls of insulation material to prematurely partially unwind if no tensioning force is being applied thereagainst. The paddle assembly 60 therefore acts as a breaking mechanism to prevent such unwinding.

The biasing force associated with each respective spring member 65 is such that the paddle member 62 applies sufficient tensioning force to a fully loaded roll of insulation material when such roll is installed at any one of the proper locations associated with insulation spool assembly 10. Based upon this predetermined force, as that roll of material unwinds, spring member 65 will continue to apply sufficient force against a roll of insulation material as such roll unwinds during use. A portion of the opposite end 64 of the paddle member 62 may be curved or angularly oriented so as to increase its frictional engagement with a particular roll of insulation material. It is recognized that any plurality of paddle assemblies 60 can be associated with any particular support shaft 68 and any particular roll of insulation material. It is also recognized that the end portion 64 may be roughened or otherwise textured so as to increase its gripping action when engaged with the insulation material.

Figure 11:
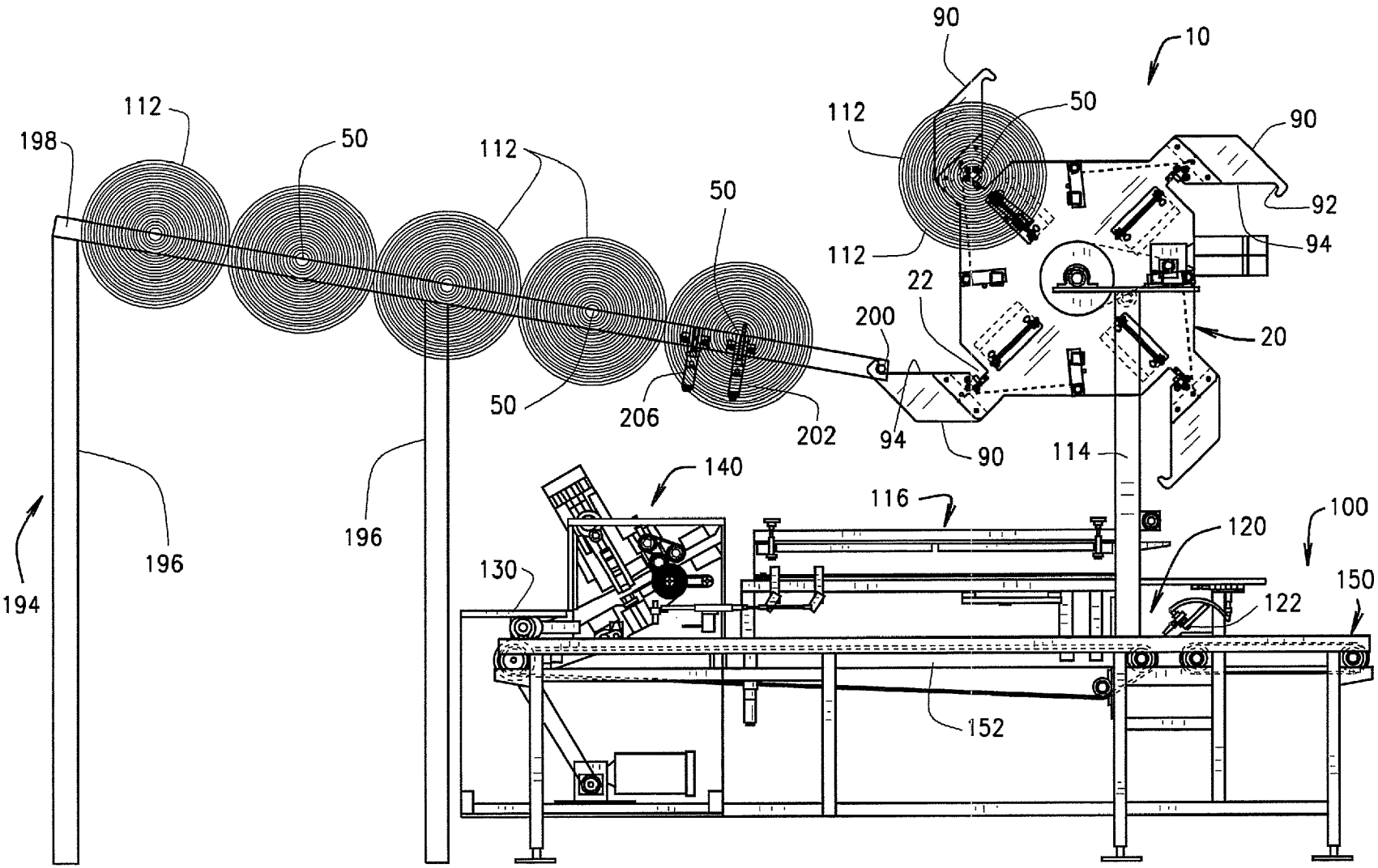
FIG. 11 is a side elevational view of a feeder mechanism constructed according to the teachings of the present invention for use with the present spool apparatus for holding and feeding rolls of insulation material for loading onto the preset spool apparatus.
Figure 12:
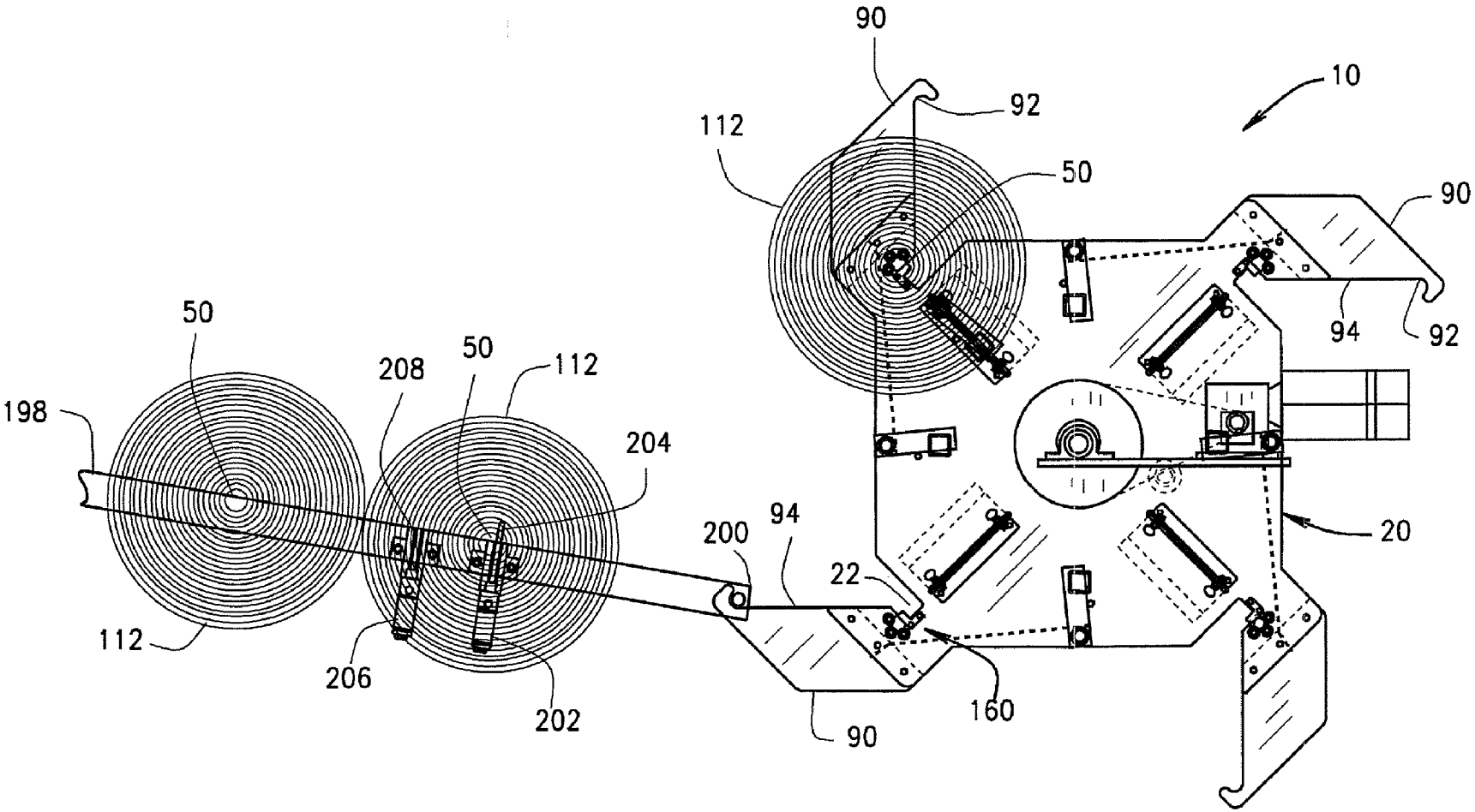
FIG. 12 is a partially exploded view of FIG. 11.

The present insulation spool assembly 10 also lends itself for use with an automatic feeder mechanism which can be properly positioned and located for holding and feeding a plurality of rolls of insulation material 112 onto the present spool apparatus 10. For example, in another aspect of the present invention as best illustrated in FIGS. 11 and 12, a feeder mechanism 194 can be constructed in accordance with the teachings of the present invention so as to gravity feed one or more rolls of rolled material 112 for loading onto the spool apparatus 10. In the exemplary embodiment of FIGS. 11 and 12, the feeder mechanism 194 may include any plurality of upright support members 196 which are positioned and located to support at least a pair of spaced apart inclined support members 198 which form an inclined surface upon which the rolled material 112 will be positioned for gravity feeding therealong. In this regard, each roll of insulation material 112 includes its respective support shaft 50 for carrying such rolled material and the inclined support members 198 are sufficiently spaced apart such that the exposed opposite end portions of the respective support shafts 50 will rest upon and gravity feed along the support members 198 towards the respective terminal end portions 200 thereof. In the embodiment illustrated in FIGS. 11 and 12, the terminal end portions of the inclined support members 198 forming the support surface for gravity feeding any number of rolls of insulation material 112 onto the spool assembly 10 are positioned in spaced apart relationship above the guide mechanism 116. This is advantageous in that an expended roll of insulation material can be released and removed from the spool apparatus 10 in the vicinity of the guide mechanism 116 as previously explained. Once the support shaft 50 associated with the expended rolled material 112 is removed from the assembly 10, the spool apparatus can be rotated as previously explained to a loading position adjacent the terminal end portions 200 of the inclined support members 198 as best illustrated in FIGS. 11 and 12.

Since the weight of the various rolls of insulation material 112 provide the gravity feed force for moving such rolled material 112 along the inclined surface formed by the support members 198 towards the terminal end portions 200, the inclination of support members 198 can vary and need not be greater than approximately 2° inclination depending upon the particular application. In this regard, it is also recognized and anticipated that the entire structure of the feeder mechanism 194 can take on a wide variety of different shapes and configurations including a stair-step arrangement wherein some rolls of insulation material rest on a substantially flat or horizontal plane during their movement along support members 198 towards the ready or loading position near the terminal end portions 200. Other configurations of the feeder mechanism 194 may include a mezzanine platform positioned above apparatus 100 including an inclined plane or chute for again gravity feeding various rolls of insulation material 112 to a loading or ready position as illustrated in FIGS. 11 and 12. Still other feeder mechanism constructions are envisioned and will work equally as well with the present spool apparatus 10 so long as the rolls of insulation material 112 are moved to a proper loading or ready position.

The present feeder mechanism 194 also includes a stop mechanism 202 for engaging the forwardmost roll of insulation material 112 and holding such rolled material in a ready position for loading onto the spool assembly 10. The stop mechanism 202 is movable between a stop position wherein the forwardmost rolled material 112 is held in a ready position for loading onto the spool apparatus 10 and a released position wherein the rolled material is free to move under gravity onto the support apparatus 10. In the exemplary embodiment illustrated in FIGS. 11 and 12, the stop mechanism 202 includes a pair of pneumatically actuated cylinders mounted respectively in aligned relationship to the respective inclined support members 198 at a location therealong such that the forwardmost roll of insulation material 112 is positioned adjacent the respective terminal end portions 200 thereof at a location which will not interfere with the normal operation and movement of the spool assembly 10 as the rolled material 112 loaded onto the spool assembly 10 are rotated during normal operation. The pneumatic cylinders 202 each include an actuating arm 204 which is pneumatically actuated and controlled by the operator of the spool apparatus 10 in a conventional manner between a stop position wherein the actuating arm 204 is in an up position and engages one end portion of the exposed support shaft 50 associated with the forwardmost roll of material thereby preventing further movement of that particular roll of insulation material 112 along the support members 198, and a released position wherein the actuating arm 204 retracts within the cylinder and is in a down position no longer engaging the support shaft 50 thereby allowing the roll of insulation material 112 to continue to move towards the terminal end portions 200 of the inclined support members 198. The actuating cylinders 202 are attached to the respective support members 198 in a conventional manner and are properly positioned and located such that the respective actuating arms 204 will engage the respective end portions of the support shaft 50 as previously explained.

The present feeder mechanism 194 may likewise include a second stop mechanism 206 which is likewise positioned and located for attachment to the respective support members 198 at a location therealong for engaging the rolled material positioned aft of or adjacent the forwardmost rolled material 112 as best illustrated in FIGS. 11 and 12. The stop mechanism 206 is likewise positioned and located to hold the adjacent rolled material 112 in a stationary position while the forwardmost rolled material is released for loading onto the spool assembly 10. In similar fashion, the second stop mechanism 206 is movable between a stop position wherein the adjacent rolled material is held in a stationary position and a released position wherein the adjacent rolled material is free to move under gravity to the forwardmost ready position for subsequent loading onto the spool assembly 10. In the exemplary embodiment illustrated in FIGS. 11 and 12, like stop mechanism 202, stop mechanism 206 is illustrated as being a pair of pneumatically actuated cylinders each of which include an actuating arm 208. Like actuating arm 204, actuating arm 208 is movable between a stop position wherein actuating arm 208 is in an up position and engages one end portion of the support shaft 50 associated with the roll of insulation material 112 positioned adjacent the forwardmost roll of insulation material, and a released position wherein the actuating arm 208 retracts within the cylinder 206 and no longer engages the support shaft 50 thereby allowing the adjacent rolled material 112 to move under gravity to the forwardmost loading position. Here again, the actuating cylinders 208 are attached to the respective support members 198 in spaced apart aligned relationship in a conventional manner.

As illustrated in FIGS. 11 and 12, the first and second stop mechanisms 202 and 206 are positioned and located relative to each other such that the plurality of rolls of insulation material 112 touch each other as they are positioned on the inclined support members 198. This arrangement allows the weight of each respective rolled material 112 to help move the respective plurality of rolls of insulation material in a gravity feed operation when the forwardmost roll of insulation material 112 is released for loading onto the spool assembly 10. In this regard, when the first pair of actuating cylinders 202 are positioned in their stop position such that their respective actuating arms 204 are engaged with the opposite end portions of the support shaft 50 associated with the forwardmost rolled material 112, the entire plurality of rolls of insulation material are held in a stationary position as illustrated in FIGS. 11 and 12. In this configuration, when the first stop mechanism 202 is positioned in its stop position, the second stop mechanism 206 can be positioned in its released position since the first stop mechanism 202 will hold the entire plurality of rolled material 112 in a stationary position. When the forwardmost roll of insulation material 112 is ready for loading onto the spool assembly 10, the first stop mechanism 202 is moved to its released position and the second stop mechanism 206 is moved to its stopped position. This allows the forwardmost roll of insulation material to move under the force of gravity to the terminal end portions 200 of support members 198 as will be hereinafter further explained whereas the remaining rows of insulation material 112 will likewise move under the force of gravity until the roll of insulation material positioned adjacent the forwardmost roll of insulation material engages the second stop mechanism 206. At this point, the remaining rolls of insulation material are held in a stationary position while loading of the forwardmost roll of insulation material is completed on spool assembly 10. In this regard, prior to releasing the forwardmost roll of insulation material 112 for loading onto the spool assembly 10, spool assembly 10 is rotated by the operator such that the appropriate pair of hook plates 90 are position adjacent the terminal end portions 200 of the support members 198 as illustrated in FIGS. 11 and 12. Once in this position, the forwardmost roll of insulation material is released by the first stop mechanism 202 and such forwardmost rolled material will move under the force of gravity along the remaining length of support members 198 and onto the respective hook plates 90 associated with spool assembly 10.

As previously explained, once the opposite end portions of the support shaft 50 associated with the forwardmost roll of insulation material are engaged with the respective hook plates 90, an operator can simply engage the spool motor 40 and further rotation of the first and second spool plates 20 and 30 in a clockwise direction as viewed in FIG. 3 will allow the engaged insulation roll support shaft 50 to be lifted and the angled hook plate surface 94 will guide the support shaft 50 therealong into engagement with the receptacles 22 and 32 as previously explained. Further rotation of the first and second spool plates 20 and 30 will again allow the opposite end portions of the insulation roll support shaft 50 to engage the recesses 23 and 33 as previously explained with respect to FIGS. 6 and 8 and the respective locking mechanisms associated with the spool plates 20 and 30 will be engaged as previously explained. At this point, the forwardmost roll of insulation material associated with the feeder mechanism 194 is fully engaged and locked with the spool assembly 10 and is ready for operational use.

Once loading of the forwardmost roll of insulation material 112 from the feeder assembly 194 is accomplished, the operator can activate the first stop mechanism 202 such that the actuating arms 204 are moved to their stop position and the operator can then move the actuating arms 208 associated with the second stop mechanism 206 to their released position thereby allowing the forwardmost roll of insulation material associated with the feeder mechanism 194 and all remaining rolls of insulation material to move forward along support members 198. When the second stop mechanism is moved to its released position, the forwardmost rolled material 112 will move into the ready position and will engage the first stop mechanism 202 and will be held there until such rolled material is ready for loading onto the spool assembly 10.

It is recognized that the first and second stop mechanisms 202 and 206 can be independently and separately actuated by the operator of the overall apparatus to accomplish loading and staging of the various rows of insulation material associated with the feeder mechanism 194. It is also recognized and anticipated that the stop mechanisms 202 and 206 can be simultaneously sequentially operated such that when the first stop mechanism is moved to its stopped position, the second stop mechanism is simultaneously moved to its released position, and vice versa. This sequential operation of the first and second stop mechanisms 202 and 206 may improve loading efficiency and reduce the overall time involved for accomplishing this operation under certain circumstances. It is also recognized that the second forwardmost roll of insulation material positioned adjacent the forwardmost rolled material 112 does not have to touch or engage the forwardmost rolled material as illustrated in FIGS. 11 and 12. Instead, this adjacent roll of insulation material can be staged or indexed at a position and location along support members 198 such that the first and second rolls of insulation material do not touch each other. In this regard, the second stop mechanism 206 can be appropriately positioned and located in spaced apart relationship from the first stop mechanism 202 along support members 198 to accomplish this spacing. In this event, operation of the respective stop mechanisms 202 and 206 will be somewhat different in that stop mechanism 206 will need to be positioned in its stop position at the same time the first stop mechanism 202 is positioned in its stop position holding the forwardmost rolled material 112 in the ready position for loading. In this configuration, the forwardmost rolled material 112 can be released and loaded onto the spool assembly 10 before moving the remaining plurality of rolled material along support members 198 and before moving the next rolled material 112 into the ready position. Other stop mechanism configurations and actuating sequences are likewise envisioned and anticipated.

It is further recognized and anticipated that a wide variety of different types of stop mechanism can be utilized to accomplish the function and operation of stop mechanisms 202 and 206. It is also recognized that such stop mechanisms can be electrically, hydraulically, pneumatically, and manually operated to achieve the same overall purpose. Still further, pneumatic cylinders could be replaced with electrically or hydraulically operated cylinders. Still other stop mechanisms are envisioned and anticipated.

In addition, it is also recognized and anticipated that the feeder mechanism 194 could be positioned so as to feed onto the spool assembly 10 from the opposite direction as illustrated in FIGS. 11 and 12. In other words, the feeder mechanism 194 would extend to the right of support frames 114 illustrated in FIG. 11. In this particular configuration, spool assembly 110 would be mounted in a reverse configuration such that rotation for loading would be in a counterclockwise direction. In all other respects, the function and operation of spool assembly 10 is as previously explained.

Figures 1, 2:
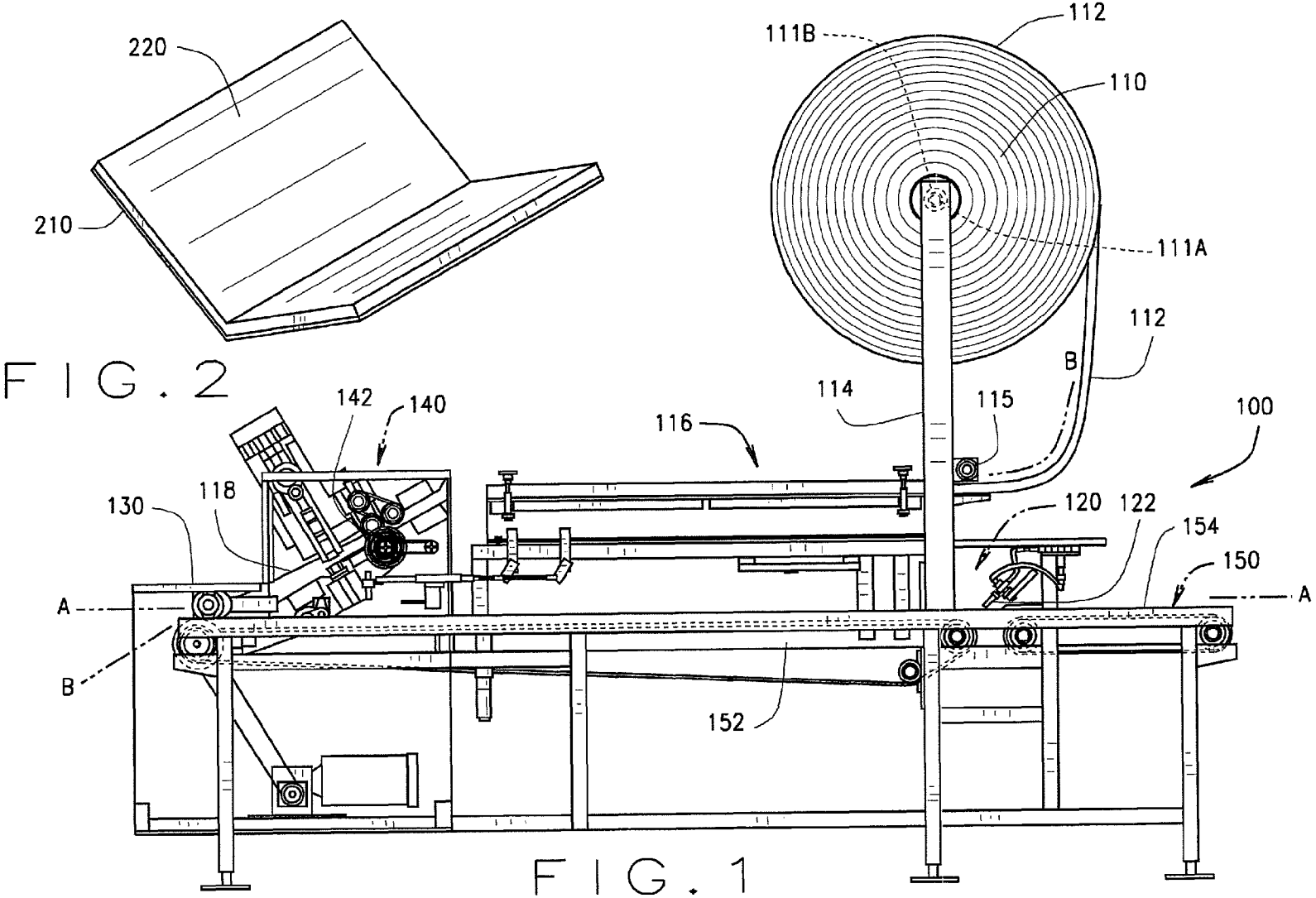
FIG. 1 PRIOR ART
FIG. 1 is a plan schematic view of a conventional prior art apparatus for applying insulation material to sheet metal ductwork.
FIG. 2 is a perspective view of ductwork with insulation lining.

The present insulation spool assembly 10 therefore provides an improvement over the prior art structure illustrated in FIG. 1 wherein only a single spool 110 of insulation material can be removably mounted to the apparatus 100. In total contrast, the spool assembly 10 can hold any plurality of rolls of insulation material and a single workman can easily load and unload rolls of insulation material due to the locking mechanisms 160 and 180 associated with the respective spool plates 20 and 30 regardless of whether the feeder mechanism 194 is used. The present insulation spool apparatus 10 therefore greatly improves the overall time efficiency and workman efficiency associated with loading and unloading rolls of insulation material, and it allows a user to load different types and different sizes and thicknesses of insulation material at a single time onto the spool assembly 10 for processing differently sized sheet metal sections for different jobs or different applications without incurring the substantial down time associated with the prior art apparatus illustrated in FIG. 1. With the present spool assembly 10, once a particular job or application related to a particular sized sheet metal section has been completed, the operator merely unfeeds and rewinds the particular roll of insulation material previously in use and then rotates the spool assembly 10 to the appropriate roll of insulation material already loaded onto the spool assembly 10 for the next job application. Once that particular roll of insulation material is properly rotated, the operator merely feeds and guides the insulation material into the transition station 140 and production can be resumed. Besides applying insulation material to sheet metal sections for ductwork, it is also recognized and anticipated that the present spool assembly 10 can be utilized with other equipment and other apparatus for lining or attaching any type of material including a wide variety of different types of fabrics to a wide variety of different types of work pieces or products.

It is also recognized that the specific shape and configuration of the various members and assemblies associated with the present invention as illustrated in FIGS. 3-12 are subject to wide variations and all such members and assemblies may be sized and shaped into a wide variety of different sizes and configurations so as to be compatible with a particular application, or with particular machinery without impairing the teachings and practice of the present invention. Other variations and modifications to the various components comprising the present structures are also contemplated.

Thus, there has been shown and described several embodiments of a novel insulation spool assembly which is adaptable for use with roll forming equipment, and with a wide variety of other apparatus, for applying and attaching insulation material or other materials to sheet metal ductwork or other work pieces or products. Many changes, modifications, variations and other uses and applications of the present invention will, however, become apparent to those skilled in the art after considering this specification and the accompanying drawings. All such changes, modifications, variations and other uses and applications which do not depart from the spirit and scope of the present invention are deemed to be covered by the present invention.

As is evident from the foregoing description, certain aspects of the present invention are not limited by the particular details of the examples illustrated herein, and it is therefore contemplated that still other modifications and applications, or equivalents thereof, will occur to those skilled in the art.

The invention claimed is:

1. A spool apparatus for providing rolled material for attachment to sheet ductwork comprising:

a drive shaft;

a pair of spaced apart first and second spool plates coupled to the drive shaft for rotational movement thereabout, the first and second spool plates being adapted for holding a plurality of rolled material, each rolled material including a support shaft for carrying the rolled material; and a plurality of receptacles positioned in spaced apart relationship along each of the first and second spool plates, the receptacles being positioned and located for holding the opposite end portions of each support shaft holding the respective rolled material such that the first and second spool plates can simultaneously hold a plurality of rolled material, each of the rolled material being movable into a feed position for feeding the rolled material from the spool apparatus for attachment to sheet ductwork; and a plurality of hook plates peripherally spaced along the perimeter of each of said first and second spool plates, each hook plate being positioned and located adjacent a respective receptacle and each including a shaft engaging recess formed at one end portion of the hook plate for engaging one end portion of a respective support shaft when the first and second spool plates are rotated into an operative position for engaging a respective support shaft, each hook plate being configured such that the engaged one end portion of the support shaft is guided along the surface of the hook plate into engagement with a corresponding receptacle when said spool plates are further rotated to an upward tilted position.

2. The spool apparatus of claim 1 wherein the first spool plate further includes a manually operated shaft lock assembly associated with each respective receptacle for holding one end portion of a support shaft in a locked position with the first spool plate.

3. The spool apparatus of claim 2 wherein the manually operated shaft lock assembly includes:

a pivotally rotatable lever member having one arm portion associated therewith movable between a first closed position wherein the arm portion extends across the support shaft end portion positioned within one of the receptacles and a second open position wherein the arm portion is moved out of engagement with the support shaft end portion thereby allowing the support shaft end portion to be removed from the receptacle; and a locking pin configured to hold the shaft lock assembly in its locked position thereby preventing the one end portion of the support shaft from exiting the receptacle regardless of the orientation of such receptacle as the first spool plate rotates throughout 360° of rotation.

4. The spool apparatus of claim 1 wherein the second spool plate further includes a rotary latch assembly associated with each respective receptacle for holding one end portion of the support shaft in a locked position with the second spool plate, the rotary latch assembly being rotatable in one direction only and resisting rotation in the opposite direction once the support shaft is positioned within the receptacle.

5. The spool apparatus of claim 4 wherein the rotary latch assembly includes:

a rotary sprocket member having a plurality of spaced slots located between respective sprocket portions, one of said sprocket portions always extending at least partially across and closing the corresponding receptacle;

said one sprocket portion extending at least partially across the corresponding receptacle being automatically moved to allow the one end portion of the support shaft to enter the corresponding receptacle; and movement of said one sprocket portion to allow the one end portion of the support shaft to enter the corresponding receptacle automatically moving an adjacent sprocket portion into a closing position across the receptacle thereby preventing the one end portion of the support shaft from exiting said receptacle.

6. The spool apparatus of claim 5 wherein each sprocket position includes a tapered surface.

7. The spool apparatus of claim 1 further including at least one paddle assembly adapted to provide a tension force to at least one roll of material thereby preventing such roll of material from prematurely unwinding during use.

8. The spool apparatus of claim 1 including a feeder mechanism positioned and located for holding and feeding a plurality of rolled material for loading onto the spool apparatus.

9. The spool apparatus of claim 8 wherein said feeder mechanism includes an inclined support structure for holding at least one of said rolled material in a gravity feed position for loading onto the spool apparatus.

10. The spool apparatus of claim 9 including at least one first stop mechanism for engaging the forwardmost rolled material, said first stop mechanism being movable between a stop position wherein the forwardmost rolled material is held in a ready position for loading onto the spool apparatus and a released position wherein the rolled material is free to move under gravity onto the spool apparatus.

11. The spool apparatus of claim 10 including at least one second stop mechanism for engaging the rolled material positioned adjacent the forwardmost rolled material, said second stop mechanism being movable between a stop position wherein said adjacent rolled material is held in a stationary position and a released position wherein said adjacent rolled material is free to move under gravity to the ready position for loading onto the spool apparatus.

12. The spool apparatus of claim 11 wherein said first and second stop mechanisms are sequentially operated such that when said first stop mechanism is in its stop position said second mechanism is in its released position, and wherein when said first stop mechanism is in its released position said second stop mechanism is in its stop position.

13. The spool apparatus of claim 12 wherein said first and second stop mechanisms include pneumatically activated cylinders, each cylinder including an arm member movable between said stop position and said released position.

14. A spool apparatus for providing rolled material for attachment to sheet ductwork comprising:

a drive shaft;

a pair of spaced apart first and second spool plates coupled to the drive shaft for rotational movement thereabout, the first and second spool plates being adapted for holding a plurality of rolled material, each rolled material including a support shaft for carrying the rolled material;

a plurality of receptacles positioned in spaced apart axially aligned relationship along the perimeter of the first and second spool plates, each pair of axially aligned receptacles being configured for holding the opposite end portions of said support shafts for rotational movement therewithin such that the first and second spool plates can simultaneously hold a plurality of rolled material, each of the rolled material being movable into a feed position for feeding the rolled material from the spool apparatus; and a locking mechanism associated with each said receptacle for holding the respective opposite one end portions of each support shaft in a locked position on the spool apparatus, said locking mechanism including a manually operated shaft lock assembly associated with the receptacles of one of said first and second spool plates for holding one end portion of the respective support shafts in a locked position with said one spool plate, and a rotary latch assembly associated with the receptacles of the other of said first and second spool plates for holding the other end portion of the respective support shafts in a locked position with said one spool plate, the rotary latch assembly being rotatable in one direction only and resisting rotation in the opposition direction once the support shaft is positioned within the receptacle.

15. The spool apparatus of claim 14 further including:

a plurality of hook plates peripherally spaced along the perimeter of each respective spool plate adjacent to the respective receptacles for holding the respective support shafts, each of the hook plates being configured to guide one end portion of a respective support shaft into its corresponding receptacle as the spool apparatus is rotated into engagement with said support shaft.

16. The spool apparatus of claim 15 wherein each of the hook plates includes a shaft engaging recess formed at one end portion of the hook plate, the shaft engaging recess being configured for engaging the one end portion of each support shaft such that the engaged support shaft is guided along the surface of the hook plate into engagement with the corresponding receptacle.

17. The spool apparatus of claim 15 further including at least one paddle assembly adapted to provide a tension force to at least one roll of material thereby preventing such roll of material from continuing to unwind by inertia when the feeding process stops.

18. The spool apparatus of claim 14 wherein the manually operated shaft lock assembly includes:

a pivotally rotatable lever member having one arm portion associated therewith movable between a first closed position wherein the arm portion extends across the support shaft end portion positioned within one of the receptacles and a second open position wherein the arm portion is moved out of engagement with the support shaft end portion thereby allowing the support shaft end portion to be removed from the receptacle; and a locking pin configured to hold the shaft lock assembly in its locked position thereby preventing the one end portion of the support shaft from exiting the receptacle regardless of the orientation of such receptacle as the at least one spool plate rotates throughout 360° of rotation.

19. The spool apparatus of claim 14 wherein the rotary latch assembly includes:

a rotary sprocket member having a plurality of spaced slots located between respective sprocket portions, one of said sprocket portions always extending at least partially across and closing the corresponding receptacle;

said one sprocket portion extending at least partially across the corresponding receptacle being automatically moved to allow the one end portion of the support shaft to enter the corresponding receptacle; and movement of said one sprocket portion to allow the one end portion of the support shaft to enter the corresponding receptacle automatically moving an adjacent sprocket portion into a closing position across the receptacle thereby preventing the one end portion of the support shaft from exiting said receptacle.

20. The spool apparatus of claim 19 wherein each sprocket position includes a tapered surface.

21. A spool apparatus for providing rolled material comprising:

a drive shaft;

a pair of spaced apart first and second spool plates coupled to the drive shaft for rotational movement thereabout, the first and second spool plates being adapted for holding a plurality of rolled material, each rolled material including a support shaft for carrying the rolled material;

a plurality of receptacles positioned in spaced apart axially aligned relationship along the perimeter of the first and second spool plates, each pair of axially aligned receptacles being configured for holding the opposite end portions of said support shafts for rotational movement therewithin such that the first and second spool plates can simultaneously hold a plurality of rolled material, each of the rolled material being movable into a feed position for feeding the rolled material from the spool apparatus;

a manually operated shaft lock assembly associated with each of the receptacles of one of said first and second spool plates for holding one end portion of each of the respective support shafts in a locked position with said one spool plate;

a rotating latch assembly associated with each of the receptacles of the other of said first and second spool plates for holding the other end portion of each of the respective support shafts in a locked position with said one spool plate, said rotating latch assembly being rotatable in one direction only and resisting rotation in the opposition direction once the support shaft is positioned within a receptacle; and a plurality of hook plates peripherally spaced along the perimeter of each of said first and second spool plates adjacent to the respective receptacles for holding the respective support shafts, each of the hook plates including a shaft engaging recess formed at one end portion of each of said hook plates for engaging one end portion of a support shaft when the first and second spool plates are rotated into an operative position for engaging a respective support shaft, each hook plate further including a surface for automatically guiding the one end portion of the support shaft when it is engaged with the shaft engaging recess into engagement with a corresponding spool plate receptacle when said spool plates are further rotated to an upward tilted position.

22. The spool apparatus of claim 21 wherein the manually operated shaft lock assembly includes:

a pivotally rotatable lever member having one arm portion associated therewith movable between a first closed position wherein the arm portion extends across the support shaft end portion positioned within one of the receptacles and a second open position wherein the arm portion is moved out of engagement with the support shaft end portion thereby allowing the support shaft end portion to be removed from the receptacle; and a locking pin configured to hold the shaft lock assembly in its locked position thereby preventing the one end portion of the support shaft from exiting the receptacle regardless of the orientation of such receptacle as the corresponding spool plate rotates throughout 360° of rotation.

23. The spool apparatus of claim 21 wherein the rotary latch assembly includes:

a rotary sprocket member having a plurality of spaced slots located between respective sprocket portions, one of said sprocket portions always extending at least partially across and closing the corresponding receptacle;

said one sprocket portion extending at least partially across the corresponding receptacle being automatically moved to allow the one end portion of the support shaft to enter the corresponding receptacle; and movement of said one sprocket portion to allow the one end portion of the support shaft to enter the corresponding receptacle automatically moving an adjacent sprocket portion into a closing position across the receptacle thereby preventing the one end portion of the support shaft from exiting the receptacle.

24. The spool apparatus of claim 23 wherein each sprocket position includes a tapered surface.

25. The spool apparatus of claim 21 further including at least one paddle assembly adapted to provide a tension force to at least one roll of material thereby preventing such roll of material from prematurely unwinding during use.

26. The spool apparatus of claim 21 including a feeder mechanism positioned and located for holding and feeding a plurality of rolled material for loading onto the spool apparatus.

27. The spool apparatus of claim 26 wherein said feeder mechanism includes an inclined support structure for holding at least one of said rolled material in a gravity feed position for loading onto the spool apparatus.

28. The spool apparatus of claim 27 including at least one first stop mechanism for engaging the forwardmost rolled material, said first stop mechanism being movable between a stop position wherein the forwardmost rolled material is held in a ready position for loading onto the spool apparatus and a released position wherein the rolled material is free to move under gravity onto the spool apparatus.

29. The spool apparatus of claim 28 including at least one second stop mechanism for engaging the rolled material positioned adjacent the forwardmost rolled material, said second stop mechanism being movable between a stop position wherein said adjacent rolled material is held in a stationary position and a released position wherein said adjacent rolled material is free to move under gravity to the ready position for loading onto the spool apparatus.

30. The spool apparatus of claim 29 wherein said first and second stop mechanisms are sequentially operated such that when said first stop mechanism is in its stop position said second mechanism is in its released position, and wherein when said first stop mechanism is in its released position said second stop mechanism is in its stop position.

31. The spool apparatus of claim 30 wherein said first and second stop mechanisms include pneumatically activated cylinders, each cylinder including an arm member movable between said stop position and said released position.

32. A method of simultaneously holding a plurality of rolled insulation material and feeding anyone of such plurality of rolled insulation material for attachment to sheet metal ductwork, the method comprising:

providing a spool apparatus for simultaneously holding a plurality of rolled insulation material, each rolled insulation material including a support shaft for carrying the rolled material, said spool apparatus including first and second spool plates each including a plurality of receptacles positioned and located in spaced apart relationship therealong for holding the opposite end portions of each support shaft;

providing a plurality of hook plates for automatically guiding the opposite end portions of each support shaft into their respective corresponding receptacles as the first and second spool plates are rotated into an operative position for engagement with a respective support shaft;

holding the plurality of rolled insulation material positioned in spaced apart relationship along the perimeter of said first and second spool plates within said receptacles;

rotating the spool apparatus to a feed position such that one of said rolled insulation material can be fed for attachment to sheet ductwork; and feeding the rolled insulation material for attachment to the sheet ductwork.

33. The method of claim 32 including locking the opposite end portions of each support shaft in their respective corresponding receptacles on the spool apparatus.

34. The method of claim 32 including providing a tension force to each respective roll of insulation material thereby preventing such rolls of insulation material from continuing to unwind by inertia when the feeding process stops.

* * * * *